US006431617B1

(12) United States Patent
Fisher

(10) Patent No.: US 6,431,617 B1
(45) Date of Patent: Aug. 13, 2002

(54) DOOR MECHANISM

(75) Inventor: Sydney Edward Fisher, West Midlands (GB)

(73) Assignee: Meritor Light Vehicle Systems (UK) Ltd., Birmingham (GB)

( * ) Notice: Subject to any disclaimer, the term of this patent is extended or adjusted under 35 U.S.C. 154(b) by 0 days.

(21) Appl. No.: 09/424,014

(22) PCT Filed: May 12, 1998

(86) PCT No.: PCT/GB98/01348

§ 371 (c)(1),
(2), (4) Date: Jan. 24, 2000

(87) PCT Pub. No.: WO98/53168

PCT Pub. Date: Nov. 26, 1998

(30) Foreign Application Priority Data

May 21, 1997 (GB) ..... 9710332

(51) Int. Cl.[7] ..... E05C 3/06; E05C 3/16

(52) U.S. Cl. ..... 292/216; 292/DIG. 23; 292/DIG. 49

(58) Field of Search ..... 292/216, DIG. 23, 292/DIG. 49

(56) References Cited

U.S. PATENT DOCUMENTS 5,603,537 A * 2/1997 Amano et al. ..... 292/201
5,683,125 A * 11/1997 Tseng ..... 292/216
5,897,148 A * 4/1999 Arabia, Jr. et al. ..... 292/216
5,921,595 A * 7/1999 Brackmann et al. ..... 292/216
6,131,337 A * 10/2000 Machida ..... 49/280
6,158,788 A * 12/2000 Ikeda et al. ..... 292/216

FOREIGN PATENT DOCUMENTS

| | | |
|---|---|---|
| EP | 0632178 | 1/1995 |
| EP | 0634548 | 1/1995 |
| GB | 2300667 | 11/1996 |

* cited by examiner

*Primary Examiner*—Anthony Knight
*Assistant Examiner*—Matthew E. Rodgers
(74) *Attorney, Agent, or Firm*—Wood, Phillips, Katz, Clark & Mortimer

(57) ABSTRACT

Vehicle door mechanism has self-acting latching means in which a latch release lever 10 (FIG. 1) operated by an inside handle of the door frees the door for opening and locking means operated by a lock drive lever 22 secures the latching means to lock the door. The two levers are coupled by motion transmitting engagement of an abutment 20 on one lever locating with a formation 34 on the other to positively shift the lock drive lever to locked condition by movement of the release lever beyond a neutral position in a first direction with a spring 36 acting between the levers to return the lock drive lever to unlocked condition when the release lever is moved the opposite way as far as or beyond the neutral position, and allowing further movement of the release lever for unlatching the door. The spring aids return of the release lever to its neutral position and the arrangement enables latching, and locking to be effected by the door handle alone.

12 Claims, 3 Drawing Sheets

DOOR MECHANISM

This invention relates to latching and locking mechanisms for doors of passenger vehicles.

Such doors are commonly provided with interior and exterior door handles operable from the inside or the outside of the vehicle respectively to release latching means of the door for opening it. Provision is also made for locking the door to resist unauthorised access by locking means acting to disable or block the latch mechanism to prevent the door being freed when closed. Even if the locking means is power operable. for example as part of a central door locking system, provision will be made on at least some of the doors for manual locking and unlocking at least from the vehicle interior and this is commonly provided by a manual push-pull button or the like, typically a cill button, separate from the interior door handle which adds to the cost and complication of the door mechanism, and may also involve additional costs in terms of layout to suit the mechanism to particular styles of door, and in terms of making the mechanism tamper-resistant for effectively deterring attempted theft of the vehicle or its contents.

The object of the invention is to provide vehicle door latching and locking mechanism of simple and economical construction, which is easy to install in a wide range of door styles and layouts, which is convenient to operate, and which may assist in or simplify provisions to improve vehicle security.

According to the invention there is provided vehicle door mechanism as defined by the characterising part of claim 1 of the appended claims.

Various forms and arrangements of the resilient means may be used including a helical compression spring acting directly between opposing parts of the two members; a tension spring coupled between the two members; or a torsion spring located with arms bearing on opposing parts of the two members. It is contemplated that, as well as metal springs of the above types, resilient means formed wholly or in part of elasto-meric or non-metallic flexure materials might be used.

Examples of the invention are now more particularly described with reference to the accompanying drawings, wherein.

Figure 6:
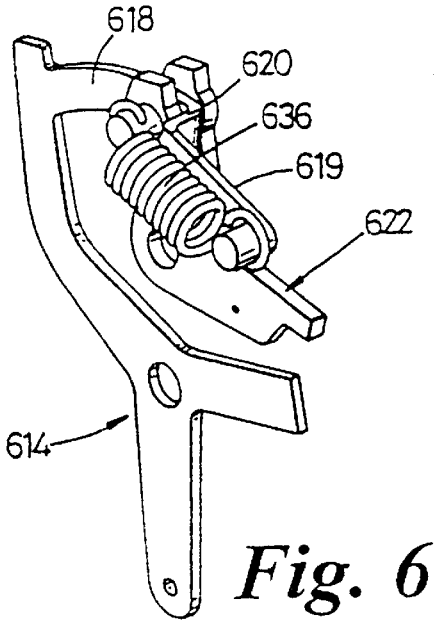
Figure 7:
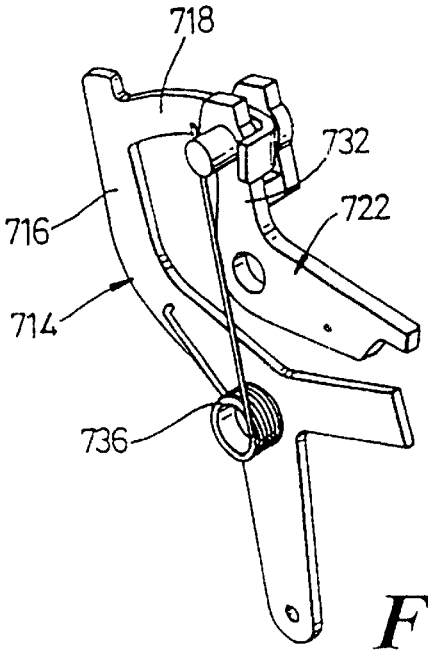
Figure 3:
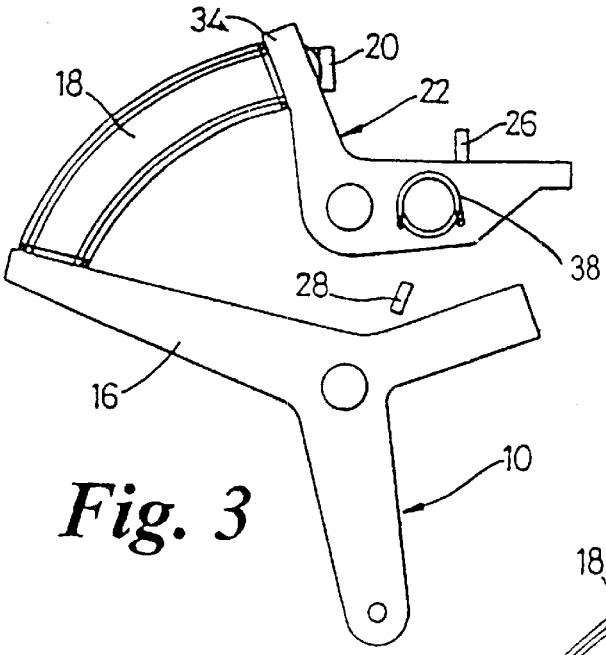
Figure 4:
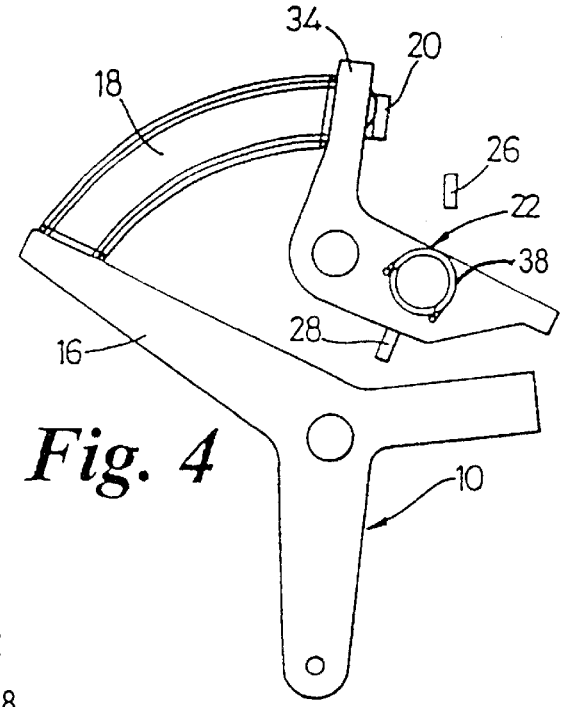
Figure 5:
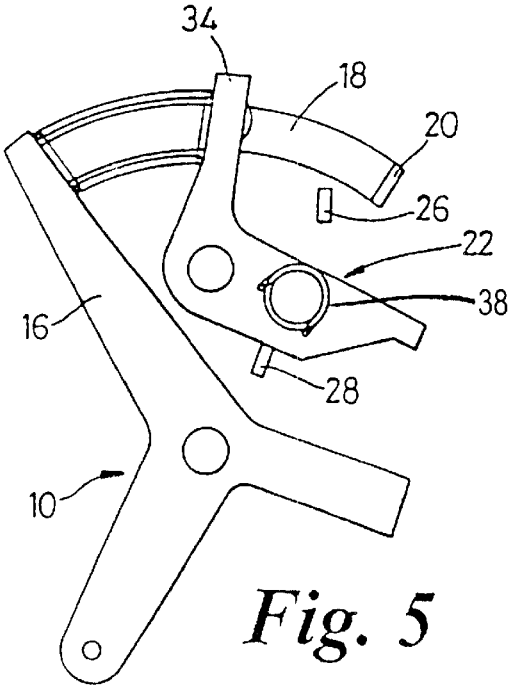

FIGS. 3, 4, & 5 are diagrams of perspective operating positions of said parts, FIG. 6 is a perspective view of equivalent parts of a second embodiment, and FIG. 7 is a perspective view of equivalent parts of a third embodiment.

Figure 1:
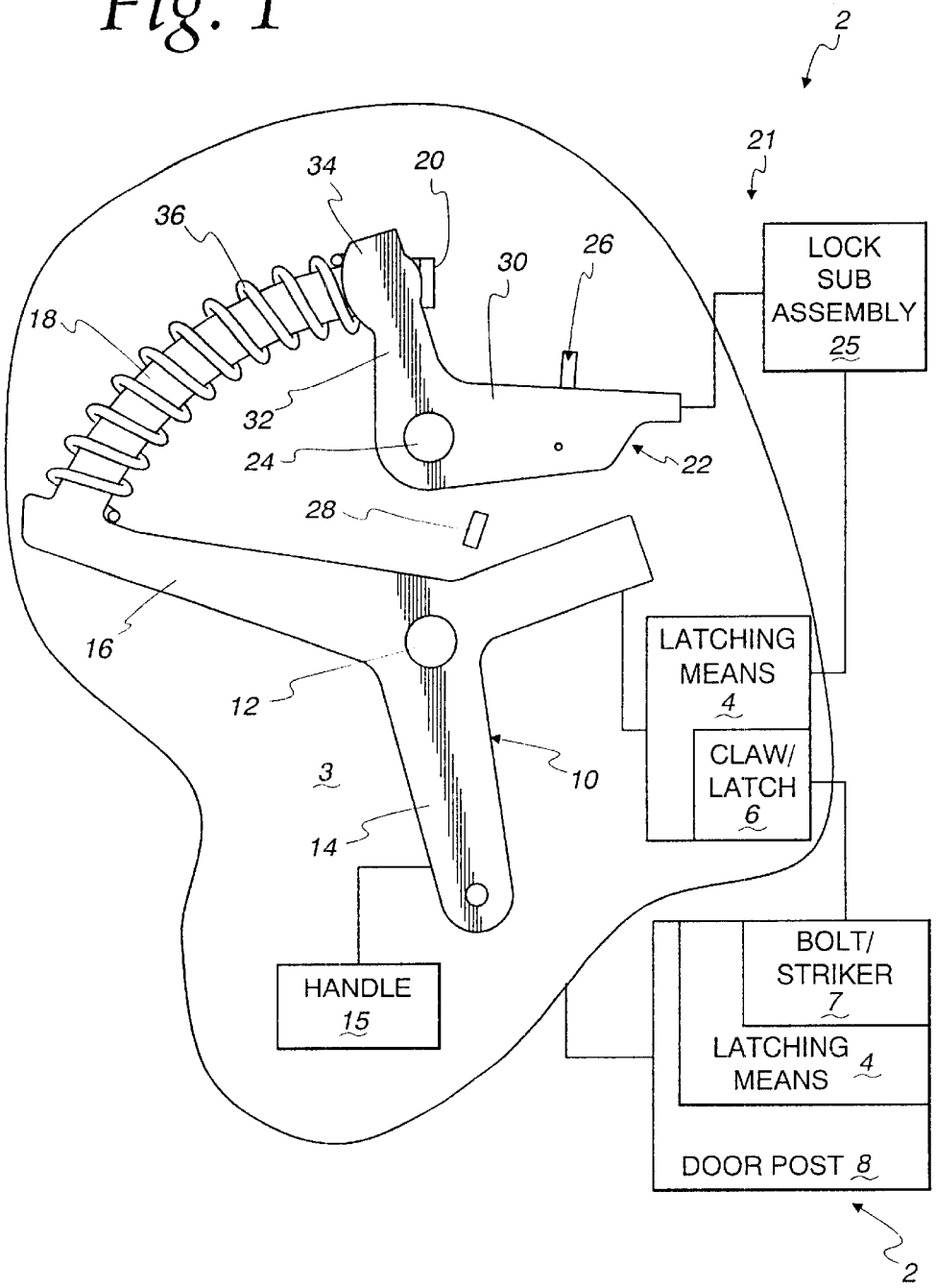
FIG. 1 is a side elevation of parts of a first embodiment of the invention. being vehicle door, latching and locking mechanism.
Figure 2:
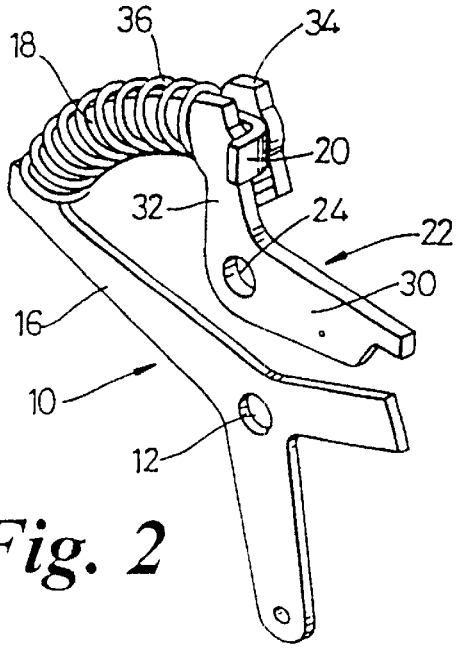
FIG. 2 is a perspective view of said parts.

Referring firstly to FIG. 1, the embodiment there shown is a locking and latching mechanism 2 for a vehicle door 3 in which the arrangement and action of most of the operating parts of the mechanism and their mounting in the door 3 are of conventional construction well known to those skilled in the art and therefore not described in detail herein.

Self-acting latching means 4 has latched and unlatched states and includes a rotating claw or other latch 6 co-acting with a bolt or striker 7 on the door post 8 in use and retained in fully closed/latched and first safety conditions by, in the case of the claw, a co-acting pawl. The pawl is linked in turn to a latch release member, in this example, a release lever 10 of bell crank form having a fulcrum pivot at 12. One arm 14 of lever 10 is linked to a manually operable interior handle 15 of the door 3.

A second arm 16 carries an arcuate abutment sector 18 projecting laterally from its distal end and centred on fulcrum 12.

The free end of sector 18 is hook shaped to form an abutment 20.

The locking means 21 of the mechanism includes a bell crank lock drive lever 22 fulcrumed about a pivot axis 24 in spaced parallel relationship to axis 12 to operate a suitable lock sub-assembly 25, having locked and unlocked states.

Referring also to FIGS. 2–5, lever 22 is angularly displaceable between locked and unlocked positions determined respectively by fixed upper and lower(as viewed in the drawings) stops 26, 28 which are abutted by opposite sides of a first arm 30 of lever 22, which locked and. unlocked positions correspond to locked and unlocked states for the lock sub-assembly 25.

Lever 22 is angularly displaceable between locked and unlocked positions determined respectively by fixed upper and lower (as viewed in the drawings) stops 26, 28 which are abutted by opposite sides of a first arm 30 of lever 22.

A second upwardly extending arm 32 of said lever has a bifurcated end 34 through which sector 18 extends, end 34 forming a formation which co-acts with abutment 20 to limit travel of release lever 10, anticlockwise as viewed in the drawings, independently of drive lever 22 but permitting substantial movement of lever 10 in the opposition direction relative to lever 22.

A helically coiled wire compression spring 36 is located on sector 18, bearing at one end against arm 16 and at the other end against arm 32 of lock drive lever 22, so as to resiliently urge the two arms away from each other towards the limit determined by abutment 20.

Drive lever 22 is provided-with an over-center spring 38 (FIGS. 3–5) which urges it into abutment with one-or the other of the stops 26, 28 once it has passed over center between them so that the locking means will not be displaced from locked or unlocked condition until appreciable operating force is applied.

The sequence of operation of the above mechanism is illustrated in FIGS. 3, 4, and 5.

In FIG. 3 release lever 10 has been shifted by means of inside door handle to its extreme anti-clockwise position as viewed in the drawings (arm 14 to its extreme right) this being its door secure position. Its movement in this direction draws lock drive lever 22 positively its to locked position against upper stop 26 by the engagement of abutment 20 with arm 34. This leaves the door latched and locked.

FIG. 4 shows release lever 10 shifted clockwise to an intermediate neutral position at which arm 14 is generally vertical. This effects unlocking, but not unlatching of the door as the movement of sector 18 to the right causes compression spring 36 to drive lever 22 clockwise, that spring being strong enough to overcome the retaining force of the over-centre spring 38, allowing arm 30 of lever 22 to move until it abuts the lower stop 28.

To open the door the inside handle is used to shift release lever 10 to its extreme clockwise position shown in FIG. 5 which will free the pawl from the claw allowing the door to unlatch for opening. This motion of lever 10 compresses spring 36 on sector 18, the latter moving through the bifurcated end 34 and the lock drive lever 22 therefore remains undisturbed against stop 28. Once unlatched the interior door handle will be released and spring 36 urges or assists in urging lever 10 back as far as its neutral position (FIG. 4).

As there is no separate cill button or equivalent for effecting manual locking and unlocking of the door from the inside of the vehicle, only one linking connection to lever 10 is needed from the single interior door handle for effecting both functions with considerable simplification in production and assembly.

Furthermore, the interior door handle is usually remote from the vulnerable window opening of the door unlike the conventional cill button which may be accessed by "fishing" if the window is left, or is forced, slightly open. The door handle can be positioned, eg in a door recess and shaped for maximum deterrence of tampering from the vehicle exterior.

FIG. 6 shows a second embodiment in which a helical coiled wire tension spring 636 is used instead of a compression spring. Levers 614 and 622 function as above described but the sector 618 carries an extension portion 619 beyond its abutment 620, tension spring 636 being linked at one end to a peg at the far end of extension portion 619, and at its other end to a peg on the bifurcated end of arm 632 of lever 622.

FIG. 7 shows yet another embodiment, the two levers 714 and 722 being shaped and functioning as described with reference to FIGS. 1–5, however, there is no spring on or connected to sector 718. Instead a torsion spring 736 is located about a shaft (not shown) on which lever 714 pivots, the spring having a first arm bearing on arm 716 of lever 714 and a second spring arm bearing against a peg on the bifurcated end of upper arm 732 of lever 722. Thus, spring 736 acts to urge the two last mentioned arms angularly apart with the same effect as the compression spring 36 of the FIG. 1 embodiment.

I claim:

1. Vehicle door mechanism including latching means changeable between latched and unlatched states for operatively holding a door on which the vehicle door mechanism is attached closed in the latched state, the vehicle door mechanism further including a latch release member (10) selectively moveable from a neutral position to a release position to thereby change the latching means from the latched state into the unlatched state so as to free the door for opening; and locking means acting to secure the latched door by preventing the latching means to be changed from the latched state into the unlatched state and including a lock drive member (22) selectively movable between locked and unlocked positions, the latching means movable from the latched state into the unlatched state with the lock drive member in the unlocked position and prevented from movement from the latched state into the unlatched state with the lock drive member in the locked position; the latch release member having a path of travel extending between said release position and a door secure position, said neutral position being in an intermediate part of said path, wherein said release member and the lock drive member are coupled by motion transmitting means including an abutment (20) on one of said members coacting with a formation (34) on the other of said members to positively shift the lock drive member to the locked position on movement of the release member from its neutral position to its door secure position, and resilient means (36; 636, 736) acting between said members to urge the lock drive member back to its unlocked position on return movement of the release member from the door secure position to or beyond the neutral position, the resilient means permitting travel of the release member to its release position but urging or contributing to the urging of said member from that position to the neutral position.

2. Mechanism as in claim 1 characterized in that the latch release member (10) and lock drive member (22) are both levers.

3. Mechanism as in claim 2 characterized in that at least one said lever (10, 22) is a bell crank lever.

4. Mechanism as in claim 3 characterized in that the latch release member (10) is operatively linked to an interior handle of the door whereby said handle serves both to unlatch the door and for its locking and unlocking.

5. Mechanism as in claims 2 or 3 characterized in that said levers (10, 22) are fulcrummed for movement about parallel axes.

6. Mechanism as in claim 2 characterized in that the resilient means is a spring (36) acting directly between arms (16, 22) of the two members.

7. Mechanism as in claim 6 characterized in that the spring is selected as one of a compression spring (36), a tension spring (636), and a torsion spring (736).

8. Mechanism as in claim 2 characterized in that the latch release member (10) is operatively linked to an interior handle of the door whereby said handle serves both to unlatch the door and for its locking and unlocking.

9. Mechanism as in claim 1 characterized in that the latch release member (10) is operatively linked to an interior handle of the door whereby said handle serves both to unlatch the door and for its locking and unlocking.

10. Mechanism as in claim 1 characterized in that the drive member (22) is provided with over-center spring means (38) urging said member towards one or other of the locked and unlocked positions once it has passed over center between them.

11. Mechanism as in claim 1 characterized in that the latch release member (10) and lock drive member (22) are both levers and the latch release member (10) is operatively linked to an interior handle of the door whereby said handle serves both to unlatch the door and for its locking and unlocking, wherein the levers are fulcrummed for movement about parallel axes.

12. Mechanism as in claim 1 characterized in that the latch release member (10) and lock drive member (22) are both levers, at least one said lever (10, 22) is a bell crank lever, and the latch release member (10) is operatively linked to an interior handle of the door whereby said handle serves both to unlatch the door and for its locking and unlocking wherein the levers are fulcrummed for movement about parallel axes.

* * * * *